United States Patent [19]

Hallissy et al.

[11] Patent Number: 4,770,253

[45] Date of Patent: Sep. 13, 1988

[54] GRADER BLADE WITH TIERED INSERTS ON LEADING EDGE

[75] Inventors: Robert P. Hallissy, Jeannette; Edmund Isakov, Latrobe; John F. Kita, Greensburg; Earle W. Stephenson, Latrobe, all of Pa.

[73] Assignee: Kennametal Inc., Latrobe, Pa.

[21] Appl. No.: 17,394

[22] Filed: Feb. 20, 1987

[51] Int. Cl.[4] ..... E02F 3/815; E02F 9/28

[52] U.S. Cl. ..... 172/701.3; 37/141 R; 172/747; 175/410

[58] Field of Search ..... 172/701.1, 701.3, 647, 172/745; 175/410, 409; 37/141 R, 266; 299/79, 88, 93

[56] References Cited

U.S. PATENT DOCUMENTS

| | | | |
|---|---|---|---|
| 1,922,917 | 8/1953 | Russel et al. | 37/143 |
| 3,529,677 | 9/1970 | Stephenson | 172/767 |
| 3,790,353 | 2/1974 | Jackson et al. | 29/182.7 |
| 3,888,027 | 6/1975 | Toews | 37/141 R |
| 3,934,654 | 1/1976 | Stephenson et al. | 172/719 |
| 3,971,323 | 7/1976 | Beiswenger | 104/10 |
| 3,984,910 | 10/1976 | Helton et al. | 29/420 |
| 4,052,802 | 10/1977 | Moen et al. | 37/141 R |
| 4,086,966 | 5/1978 | Lamz | 172/701.3 |
| 4,194,790 | 3/1980 | Kenny | 175/410 |
| 4,211,508 | 7/1980 | Dill | 175/410 |
| 4,359,335 | 11/1982 | Garner | 75/208 R |
| 4,428,260 | 1/1984 | Eby | 76/104 R |

FOREIGN PATENT DOCUMENTS

| | | | |
|---|---|---|---|
| 2423963 | 12/1974 | Fed. Rep. of Germany | 172/701.3 |
| 283914 | 6/1970 | U.S.S.R. | 172/701.3 |

OTHER PUBLICATIONS

Kengard A. Grader Blades (WS 85-24) published 1985. Publication: Kengard A. Grader Blades dated 8/1983 by Kennametal, Inc.

*Primary Examiner*—Richard J. Johnson
*Attorney, Agent, or Firm*—Thomas R. Trempus

[57] ABSTRACT

A grader blade has a steel body with a bottom edge incorporating a pair of tiered, elongated carbide inserts in a forward portion thereof. The carbide inserts, being arranged in a tiered contacting relationship, are disposed in a stepped recess formed in and along the forward portion of the bottom edge of the blade body and brazed to the blade body and to each other so as to project forwardly and downwardly from the recess. A front one of the tiered inserts is composed of a cemented carbide composition having a high cobalt content, for instance 20 percent by weight, adapting it for enhanced impact wear resistance, whereas a rear one of the tiered inserts is composed of a cemented carbide composition having a low cobalt content, for instance 11.5 percent by weight, adapting it for enhanced downpressure wear resistance.

10 Claims, 1 Drawing Sheet

GRADER BLADE WITH TIERED INSERTS ON LEADING EDGE

CROSS REFERENCE TO RELATED APPLICATION

Reference is hereby made to the following copending application dealing with related subject matter and assigned to the assignee of the present invention: "Grader Blade with Casting/Inserts Assembly on Leading Edge" by Robert P. Hallissy et al, assigned U.S. Ser. No. 017,106 and filed Feb. 20, 1987, now U.S. Pat. No. 4,715,450, issued Dec. 29, 1987.

BACKGROUND OF THE INVENTION

1. Field of the Invention

The present invention generally relates to blades for graders, snow plows and the like and, more particularly, is concerned with a grader blade which incorporates a pair of tiered inserts adapting its bottom forward edge for improved impact and downpressure wear resistance.

2. Description of the Prior Art

Graders and snow plows are both well known and each have a relatively long moldboard which extends generally laterally of the surface being worked and is moved over the surface in a direction generally perpendicular to the length of the moldboard. It is conventional practice to mount a grader blade made of steel on the lower edge of such moldboard with the blade, in turn, extending downwardly below the moldboard lower edge and itself having a lower edge forming the working surface of the blade.

Grader blades made of steel have the advantage of being relatively inexpensive, but also the disadvantage of wearing out extremely rapidly. Once worn out, the steel blade must be replaced to avoid damage to the moldboard itself. The replacing of the steel blade is, of course, time consuming and also represents downtime for the equipment. Thus, over the years, various techniques, such as impregnation and hardfacing of the blade cutting edge with carbide particles, and attachment of cemented carbide inserts into or onto the blade edge have been employed in attempting to prolong the life of the steel blade. Some of these prior art techniques are used with blades disclosed in U.S. Pat. Nos. to Russell et al (1,922,917), Stephenson (3,529,677), Jackson et al (3,790,353), Beiswenger (3,971,323), Toews (3,888,027), Stephenson et al (3,934,654) and Moen et al (4,052,802), and a blade identified as Kengard A grader blade manufactured by Kennamental Corporation.

While many of these prior art blades would appear to operate reasonably well under the limited range of operating conditions for which they were designed, most seem to embody one or more shortcomings in terms of complexity, performance, reliability and cost effectiveness which make them less than an optimum design. Consequently, a need exists for a different approach to grader blade design, one which will more adequately address the kinds of wear and forces encountered by the lower end of the grader blade.

SUMMARY OF THE INVENTION

The present invention provides a grader blade designed to satisfy the aforementioned needs. The blade of the present invention is based on a double tiered cemented carbide principle—the one forward cemented carbide for face wear resistance primarily to impacts and the other rearward cemented carbide for downpressure wear resistance. In particular, the blade of the present invention has a bottom edge with a forward portion thereof incorporating a pair of elongated cemented carbide inserts. The cemented carbide inserts are arranged in a tiered contacting relationship, disposed in a stepped recess formed in and along the forward portion of the blade bottom edge, and brazed to the blade and to each other. A front one of the tiered inserts is composed of a cemented carbide composition of high cobalt content adapting it for impact wear resistance and a rear one of the tiered inserts is composed of a cemented carbide composition of low cobalt content adapting it for downpressure wear resistance. The front insert is larger in cross-section than the rear insert.

Generally speaking, the use of the two inserts in the bottom edge of a grader blade is known, for instance, in the prior art Kengard A grader blade. However, in contrast to the construction of the grader blade of the present invention, the prior art Kengard A grader blade has a front recess and an intermediate slot spaced from the front recess, with the inserts respectively disposed in the recess and the slot. The front recess is formed along the forward bottom edge of th blade, whereas the intermediate slot is formed along and opens toward the bottom edge of the blade. The slot is defined between and spaced from the front recess and a rear surface of the blade by intermediate and rear bottom end sections of the steel blade body. The front recess contains a first insert composed of Kengard A material, a metal composite of tungsten carbide particles in a matrix of tough, work-hardening stainless steel. The intermediate slot contains a second insert composed of cemented tungsten carbide containing 10 to 13 weight percent cobalt. The inserts are brazed to the steel blade body including the intermediate and rear sections thereof. In another prior art Kengard grader blade, the two inserts were spaced close to one another.

The prior art Kengard A grader blade of such construction frequently experienced binder washout between the carbide particles in the composite metal matrix, braze failure due the inherent porosity of the matrix, and overall was not cost effective. The grader blade construction of the present invention eliminates these problems.

Accordingly, the present invention is directed to a grader blade, comprising: (a) a steel body having a bottom edge with a recess formed along a forward portion of said edge; and (b) a pair of elongated inserts having different cemented carbide compositions. The inserts are arranged in a tiered contacting relationship, disposed in the recess of the blade body and brazed to the body and to each other.

More particularly, a front one of the tiered inserts is composed of a cemented carbide composition of high cobalt content adapting it for impact wear resistance. Preferebly, the cobalt content of the front insert by weight is within the range of 18 to 22 percent, and more preferably, 19.5 to 20.5 weight percent. Specifically, the composition of the front insert by weight is approximately 80 percent tungsten carbide and 20 percent cobalt. On the other hand, a rear one of the tiered inserts is composed of a cemented carbide composition of low cobalt content adapting it for downpressure wear resistance. Preferably, the cobalt content of the rear insert by weight is within the range of 10 to 13 percent, and more preferably, 11.0 to 12.4 weight percent. Specifically, the composition of the rear insert by weight is approximately 88.5 percent tungsten carbide and 11.5 percent cobalt.

Still further, the recess in the forward portion of the blade body bottom edge is stepped-shaped in cross-section. The front one of the tiered inserts is larger in cross-section than the rear one thereof adapting the tiered inserts to conform to the cross-sectional stepped-shaped configuration of the recess and project forwardly and downwardly from the recess.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
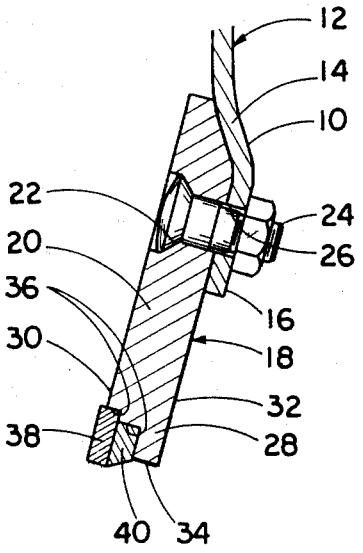
FIG. 1 is a vertical sectional view of the lower edge of a grader moldboard with a grader blade secured thereto having the construction of the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is partially shown the lower end 10 of a conventional moldboard 12, such as might be employed on a grader, scraper or snow plow. The moldboard lower end 10 has an inclined offset portion 14 and a straight terminal portion 16. A grader blade, generally designated by the numeral 18 and having the construction of the present invention, has an elongated steel body 20 with holes 22 defined in laterally spaced relation through the body. An upper end portion of the body 20 is shaped to conform to the combined contour of the inclined portion 14 and terminal portion 16 of the moldboard lower end 10 at a forward side of the moldboard 12 so as to facilitate rigid securement of the blade 18 to the moldboard 12 by bolts 24 inserted through the holes 22 in the body and through corresponding aligned holes 26 formed in the terminal portion 16 of the moldboard lower end 10.

Figure 2:
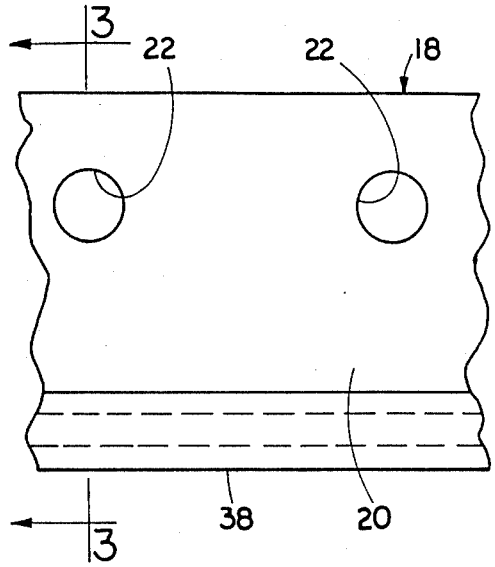
FIG. 2 is a fragmentary front elevational view of the blade removed from the moldboard.
Figure 3:
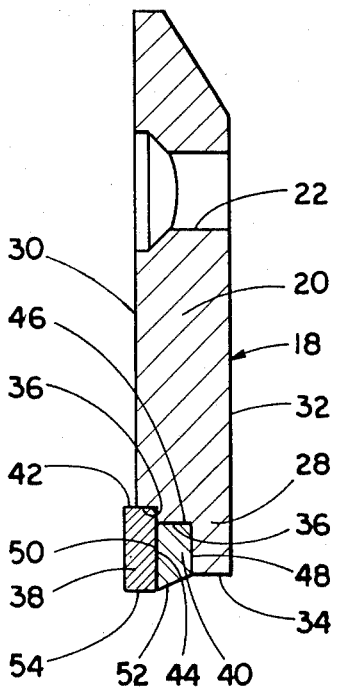
FIG. 3 is an enlarged vertical sectional view of the blade taken along line 3—3 of FIG. 2.
Figure 4:
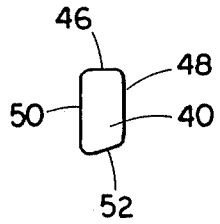
FIG. 4 is an end view of the cemented tungsten carbide insert incorporated by the grader blade of the present invention.

Turning now to FIGS. 2–4, in accordance with the construction of the grader blade 18 of the present invention, the body 20 of the blade 18 is composed of a steel alloy and has a bottom edge 28 defined by front, rear and bottom surfaces 30,32,34 of the steel body. The steel alloy is AISI 1020 in accordance with ASTM specification A36. Also, a recess 36, being preferably stepped-shaped in cross-section, is formed in and along a forward portion of the blade body edge 28 so as to open at both the front and bottom surfaces 30,34 thereof and be spaced from the rear surface thereof.

A pair of elongated front and rear inserts 38,40, having different cemented carbide compositions and being arranged in a tiered contacting relationship, are disposed in the recess 36 in the steel body 20. The inserts 38,40 are brazed to the blade body 20 and to each other at respective top and rear surfaces 42,44 of the front insert 38 and top, rear and front surfaces 46,48,50 of the rear insert 40. The braze material is Cerro W17 which has the Copper Development Association alloy number 681-02 (CDA). The inserts 38,40 are greater in cross-sectional size than that of the recess 36 such that they extend beyond the front and bottom surfaces 30,34 of the body bottom edge 28 for engaging the surface being worked when the blade 18 is in use.

Also, as readily observable in FIG. 3, the front insert 38 is larger in cross-section than the rear insert 40 to provide a combined contour adapting the tiered inserts 38,40 to conform to the cross-sectional stepped-shaped configuration of the recess 36. The rear insert 40 has a bottom inclined surface 52 which provides a transition between a bottom flat surface 54 of the front insert 38 and the bottom surface 34 of the steel body bottom edge 28. Whereas the front insert 38 is generally rectangular-shaped in cross-section, the rear insert 40 has a trapezoidal shape due to its inclined bottom surface 52.

The front carbide insert 38 is composed of a cemented carbide composition having a high cobalt content so as to adapt it for impact wear resistance during use of the grader blade 18. For instance, the cobalt content by weight might be within the range of about 18 to 22 percent, and more preferably, 19.5 to 20.5 weight percent. Preferably, the composition of the front insert 38 by weight is about 80 percent tungsten carbide and 20 percent cobalt. On the other hand, the rear insert 40 is composed of a cemented carbide composition having a low cobalt content so as to adapt it for resisting downpressure wear encountered during use of the grader blade 18. For example, the cobalt content by weight might be within the range of about 10 to 13 percent, and more preferably 11.0 to 12.4 weight percent. Preferably, the composition of the rear insert 40 by weight is about 88.5 percent tungsten carbide and 11.5 percent cobalt.

The higher cobalt content of the front insert 38 compared to that of the rear insert 40 means that the front insert 38 is tougher and less hard or less brittle so that it can better absorb impacts with the surface being worked which are directed to this region of the grader blade 18. The lower cobalt content of the rear insert 40 compared to that of the front insert 38 means that the rear insert 40, although more brittle and less tough, will wear better than the front insert 38 and thus better resist wear caused by downpressure on this region of the blade.

It is thought that the grader blade of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely a preferred or exemplary embodiment thereof.

We claim:

1. A grader blade comprising:

(a) a steel body having a bottom edge with a recess formed along a forward portion of said edge; and (b) a pair of elongated inserts having different cemented carbide compositions, said inserts being arranged in a tiered contacting relationship, disposed in said recess and brazed to said body and to each other; wherein a front one of said tiered inserts is composed of a cemented carbide composition of high cobalt content adapting it for impact wear resistance, said composition of said front insert by weight being about 80 percent tungsten carbide and 20 percent cobalt.

2. The blade as recited in claim 1, wherein a rear one of said tiered inserts is composed of a cemented carbide composition of low cobalt content adapting it for downpressure wear resistance, said cobalt content by weight being within the range of about 10 to 13 percent.

3. The blade as recited in claim 2, wherein said composition of said rear insert by weight is about 88.5 percent tungsten carbide and 11.5 percent cobalt.

4. The blade as recited in claim 1, wherein said recess is stepped-shaped in cross-section.

5. The blade as recited in claim 4, wherein one of said tiered inserts is larger in cross-section than the other adapting said tiered inserts to conform to the cross-sectional stepped-shaped configuration of said recess.

6. The blade as recited in claim 5, wherein a front one of said tiered inserts is larger in cross-section than a rear one thereof.

7. A grader blade, comprising:

(a) a steel body having a bottom edge defined by front, rear and bottom surfaces and a recess formed in and along a forward portion of said bottom edge so as to open at said front and bottom surfaces thereof and being spaced forwardly of said rear surface thereof;

(b) a pair of elongated inserts having different cemented carbide compositions, said inserts being arranged in a tiered contacting relationship, disposed in said recess and brazed to said body and to each other so as to extend beyond said front and bottom surfaces of said edge;

(c) a front one of said inserts being composed of a cemented carbide composition of high cobalt content adapting it for impact wear resistance, said composition of said front insert by weight being about 80 percent tungsten carbide and 20 percent cobalt; and (d) a rear one of said inserts being composed of a cemented carbide composition of low cobalt content adapting it for downpressure wear resistance, said composition of said rear insert by weight being about 88.5 percent tungsten carbide and 11.5 percent cobalt.

8. The blade as recited in claim 7, wherein said recess is stepped-shaped in cross-section.

9. The blade as recited in claim 8, wherein one of said tiered inserts is larger in cross-section than the other and said tiered inserts are adapted to conform to the cross-sectional stepped-shaped configuration of said recess.

10. The blade as recited in claim 9, wherein said front one of said tiered inserts is larger in cross-section than said rear one thereof.

* * * * *